US008015632B2

(12) United States Patent
Haug et al.

(10) Patent No.: US 8,015,632 B2
(45) Date of Patent: Sep. 13, 2011

(54) WALL MOUNTING FOR A SHOWER HEAD

(75) Inventors: Andreas Haug, Stuttgart (DE); Fabian Kollmann, Stuttgart (DE); Tom Schoenherr, Stuttgart (DE)

(73) Assignee: Hansgrohe AG, Schiltach (DE)

( * ) Notice: Subject to any disclaimer, the term of this patent is extended or adjusted under 35 U.S.C. 154(b) by 869 days.

(21) Appl. No.: 10/538,671

(22) PCT Filed: Nov. 21, 2003

(86) PCT No.: PCT/EP03/13056

§ 371 (c)(1),
(2), (4) Date: Apr. 27, 2006

(87) PCT Pub. No.: WO2004/055279

PCT Pub. Date: Jul. 1, 2004

(65) Prior Publication Data

US 2006/0230521 A1 Oct. 19, 2006

(30) Foreign Application Priority Data

Dec. 13, 2002 (DE) ..... 102 60 210

(51) Int. Cl.
*A47K 4/00* (2006.01)

(52) U.S. Cl. ..... 4/570; 4/615

(58) Field of Classification Search ..... 4/570, 601
See application file for complete search history.

(56) References Cited

U.S. PATENT DOCUMENTS

| | | | | |
|---|---|---|---|---|
| 1,078,283 | A * | 11/1913 | Hilfoker | 239/569 |
| 2,276,779 | A | 3/1942 | Isenberg | |
| 4,072,397 | A * | 2/1978 | Ross | 359/512 |
| 4,091,998 | A * | 5/1978 | Peterson | 239/283 |
| 4,131,232 | A * | 12/1978 | Pollinzi | 239/314 |
| 4,458,369 | A | 7/1984 | Santi | |
| 6,442,775 | B1 * | 9/2002 | Gransow et al. | 4/601 |
| D492,004 | S * | 6/2004 | Haug et al. | D23/213 |
| 7,360,723 | B2 * | 4/2008 | Lev | 239/567 |
| 2002/0035752 | A1 | 3/2002 | Gransow et al. | |

FOREIGN PATENT DOCUMENTS

CH 340460 A 8/1959

(Continued)

OTHER PUBLICATIONS

First Office Action; Patent Office of the P.R.C.; Nov. 10, 2006.

(Continued)

*Primary Examiner* — Gregory Huson
*Assistant Examiner* — Karen L Younkins
(74) *Attorney, Agent, or Firm* — Duane Morris LLP

(57) ABSTRACT

A wall mounting for a shower is mounted such as to pivot about a horizontal axis at the end thereof against the wall (1). The arm (5) has a fork at the separation from the fixing end. A clamp holder is provided in the region of the front end thereof in which a shower head (8) can be introduced. The fixing between the shower head (8) and the mounting is made by a friction connection, whereby the housing of the shower head is embodied such that it cannot be recognized from the form thereof that said housing serves for fixing.

7 Claims, 4 Drawing Sheets

FOREIGN PATENT DOCUMENTS

Figure 1:
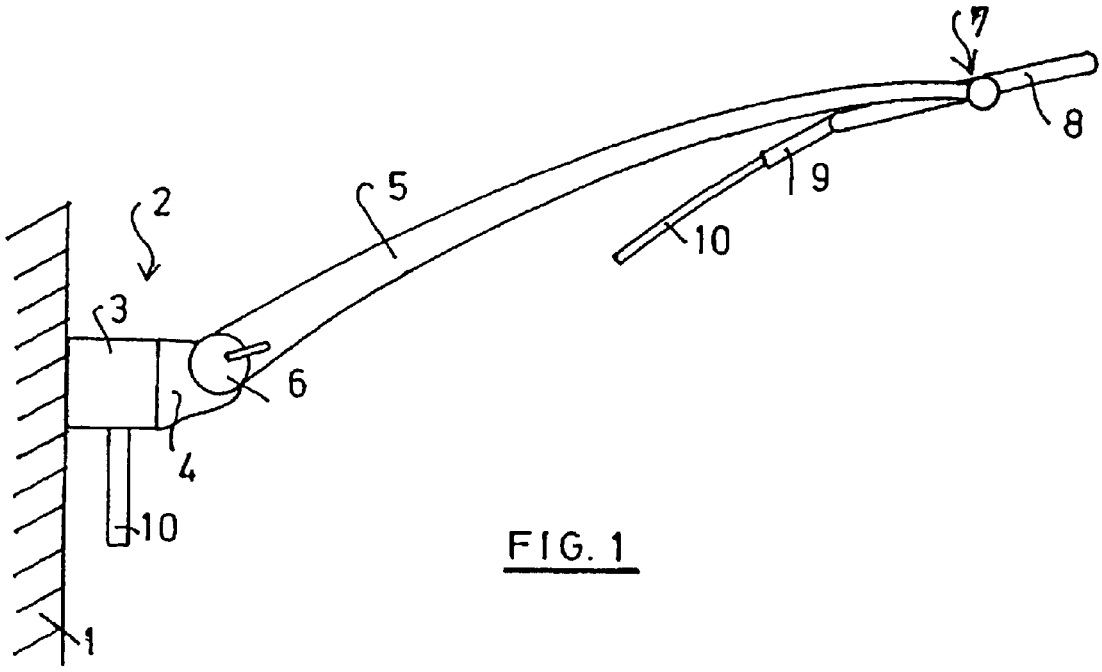

| | | | |
|---|---|---|---|
| DE | 945 116 | C | 6/1956 |
| DE | 2 342 024 | | 3/1974 |
| DE | 39 31 304 | A1 | 3/1991 |
| DE | 89 16 188 | U1 | 8/1994 |
| DE | 298 13 597 | U1 | 3/1998 |
| DE | 199 42 853 | A1 | 4/2001 |
| DE | 100 48 987 | A1 | 4/2002 |
| EP | 1 083 265 | A2 | 3/2001 |
| EP | 1083265 | A2 * | 3/2001 |
| FR | 1 042 242 | A | 10/1953 |
| JP | 8-81986 | A | 3/1996 |

OTHER PUBLICATIONS

International Search Report; Mar. 25, 2004.
German Search Report 102 60 210.7; Aug. 12, 2003.

* cited by examiner

WALL MOUNTING FOR A SHOWER HEAD

The invention is based on an arrangement with which a shower head may be mounted.

That hand-held shower heads may be held in place by a cone inserted into a conical holder is already known. The cone is situated on the hand-held shower heads, usually at the location where the shower hose is attached to their grip.

Holders, into which their grip may be emplaced or inserted, are also known.

Holders where a linkage having an eye that may be slipped onto a pin on a wall bracket or shower rod is present at the joint between the hose and handgrip are also known.

In the case of many such holders, the shower head may still be employed as such while it is in the holder. However, there are also holders where shower heads are merely held in place by, for example, eyes hung on hooks.

All known arrangements for mounting shower heads have a special facility on the shower head or its grip that users may recognize as intended for mounting purposes. Such facilities, or shape alterations, are also frequently regarded as unsightly.

The problem addressed by the invention is creating a holder for a shower head that will allow the latter to be used in a wider variety of manners.

In order to solve that problem, the invention proposes a wall mounting having those features stated under claim 1. Elaborations on the invention are covered under subclaims.

The invention allows attaching to a holder a shower head that needs no special mounting devices for attaching it to the former. In particular, the appearance of the shower head is such that it cannot be recognized that it has been designed for attachment to a holder and is suitable therefor. Designers thus have much more freedom in designing shower heads and their housings. Introducing the shower head into the holder is also much easier and greatly simplified. The shape of the shower head eases that introduction, which may be further facilitated by the holder, if deemed necessary. In the case of the usual conical holders, where the holder engages the grip, users must first feed the grip or hose on the shower head through the slot in the holder and then press the shower head into the holder along a direction orthogonal thereto. In the case of the shower head proposed here, only a single, extremely simple action, namely, sliding the shower head forward, is required.

In particular, the holder should be configured such that it engages the shower head's housing at a location thereon that is provided for that purpose, but is not recognizable as such from its shape. The properties of its housing's outer surface thus might be configured for mounting purposes at certain locations thereon, without significantly altering its housing's shape, which, in the case of this further design feature, will also allow providing that that location on the shower head's housing is intended for mating to the holder will not be recognizable as such, based on the housing's shape.

In particular, the holder may be configured such that it grips the outer perimeter of the shower head's housing.

The invention proposes, under an elaboration thereon, that the shower head remain operational following withdrawal from the holder in order that it may be employed as a shower head both while it is mated to the holder and after it has been withdrawn therefrom, which will significantly improve its utility.

In order to arrive at a particularly sensible and, in spite of the shower head's not having been specially adapted to suit the holder, reliable, mounting, according to the invention, it may be provided that the holder engages the shower head's housing at two diametrically opposed locations thereon.

The holder may, for example, have a pair of jaws that are configured for gripping the shower head's housing for that purpose.

According to the invention, it may be provided that the jaws are tensioned toward one another while the shower head is present in the holder. That tensioning may be effected by the introduction of the shower head.

Under a further elaboration on the invention, it may be provided that the jaws on the holder are interconnected by a tensioning component.

In particular, that tensioning component may be configured such that it contacts the shower head's housing over an extended area while the shower head is present in the holder, which may be effected either by adapting the shape of the tensioning component to suit that of the housing or designing the tensioning component such that it is flexible.

The tensioning component may also be configured such that it does not contact the shower head.

According to the invention, it may be provided that the shower head configured in the form of a hand-held shower head having a grip attached to its housing. The shower head is attached to the holder by its housing, rather than its grip.

It has proven to be particularly beneficial if the shower head's housing is disk-shaped.

Figure 2:
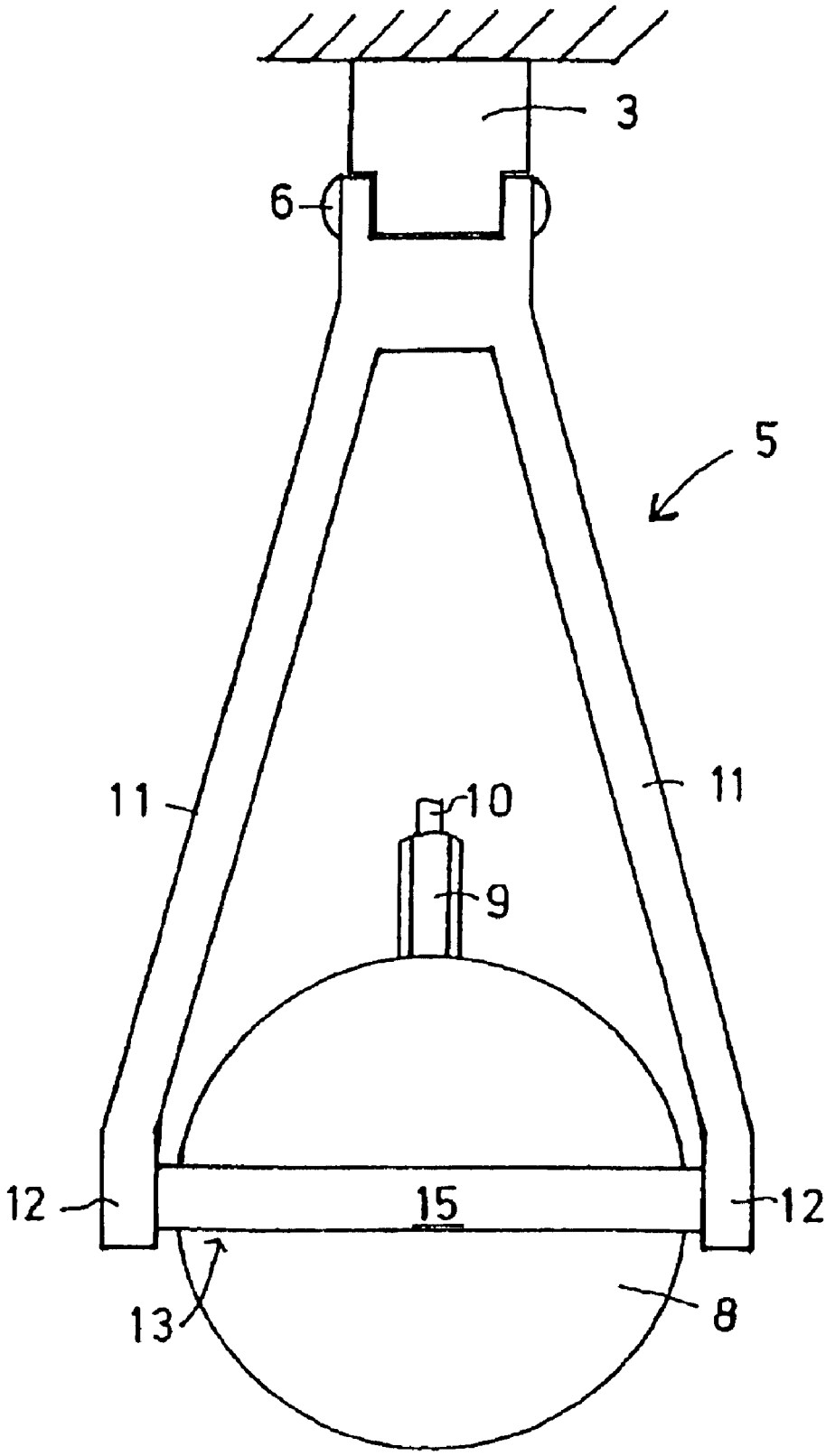
Figure 3:
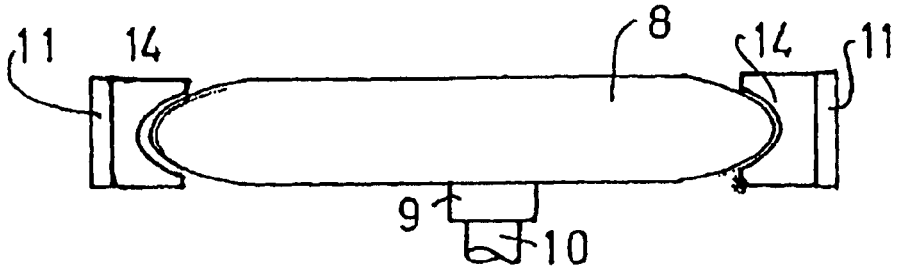
Figure 4:
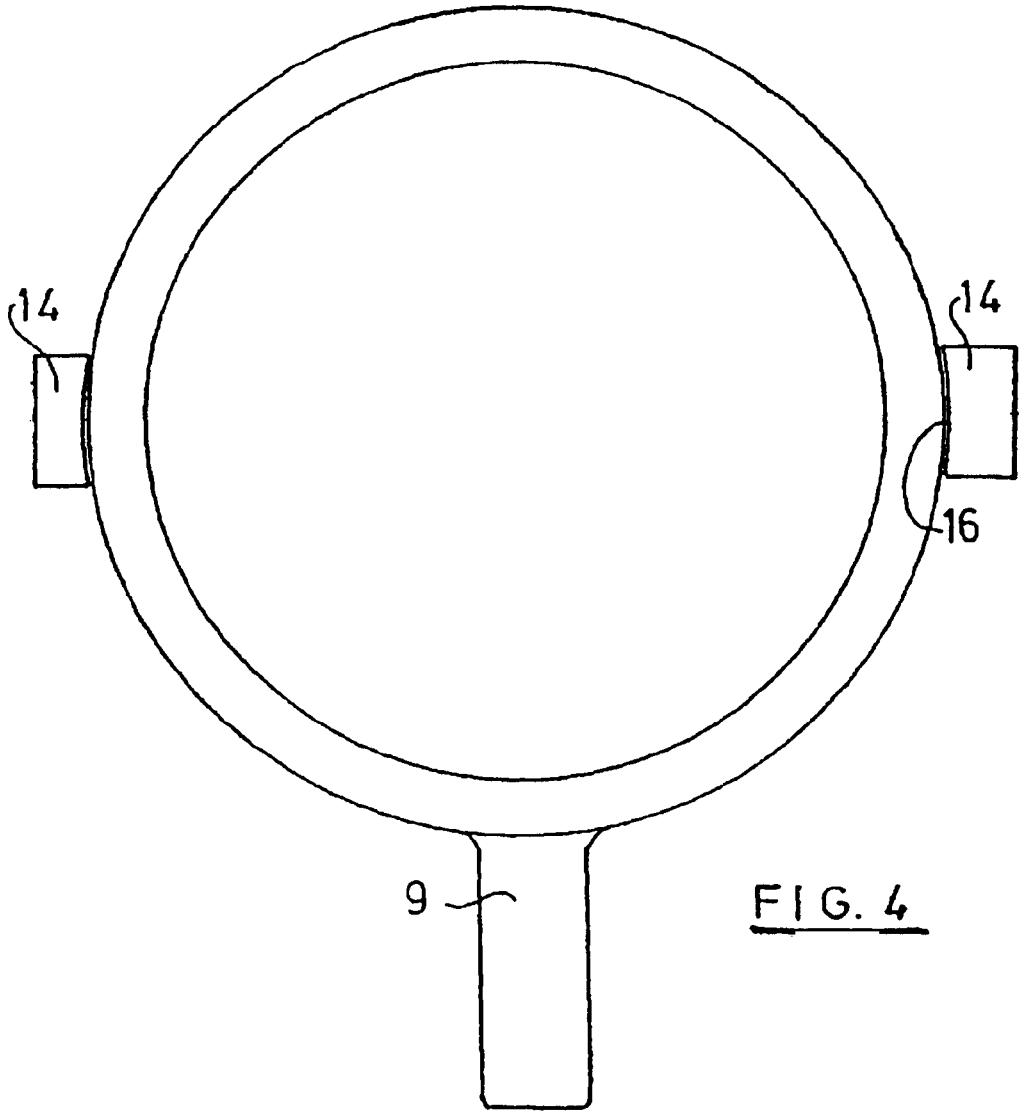
Figure 5:
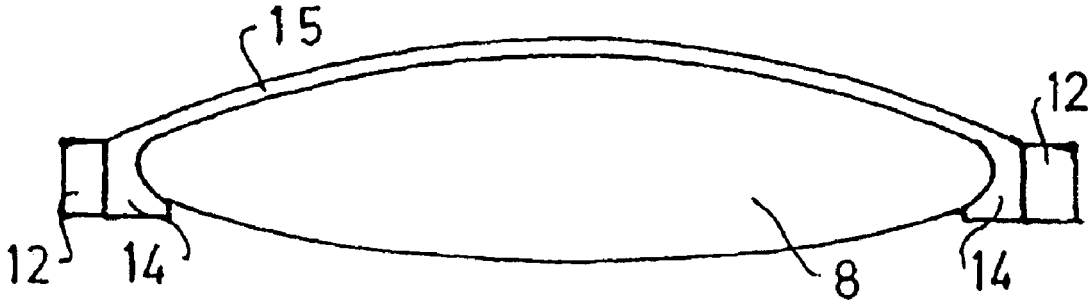

Further features, details, and benefits of the invention will be evident from the claims and the abstract, whose wordings are herewith made part of this description by way of reference thereto, the following description of a preferred embodiment of the invention, and the drawings, which depict:

FIG. 1 a schematized side view of a shower-head holder according to the invention;

FIG. 2 a simplified, schematic representation of a top view of the arrangement shown in FIG. 1;

FIG. 3 an end view of a variation on the embodiment;

FIG. 4 a view of the shower head;

FIG. 5 a representation, corresponding to that of FIG. 3, of a slightly modified embodiment.

FIG. 1 depicts a greatly simplified side view of a shower-head holder and a wall mounting according to the invention. In the case of the example shown, this shower-head holder is mounted on a wall 1. A mounting fixture 2, which, in the case of the example shown, is in the form of a console 3 that, for example, is bolted to the wall, serves to attach it to the wall. Within the console 3, the shower-head holder is connected to a water line from a mixer faucet. An arm 5 is pivoted on a protrusion 4 on the console 3. Its pivot axis is horizontal and normal to the plane of the paper. A setscrew that may be operated by a knob 6 clamps the arm 5 at a particular angular position. The arm extends away from the wall, originating at the mounting fixture 2, and terminating at its far end 7. A holder, that is not shown in any great detail in FIG. 1, for a shower head 8 is attached to the arm 5 in the vicinity of the latter's far end 7. In the case of the embodiment shown, the shower head 8 is disk-shaped and has a handgrip 9 that is slightly angularly offset from the plane of the shower head 8. Within the handgrip 9, a shower hose 10, which is not shown in detail, passes through the former and hangs freely downward therefrom. The other end of the shower hose 10 is connected to the mounting fixture 2. As has been mentioned, the arm 5 may be pivoted about a horizontal axis in order that it may take on various angular positions relative to the wall when swung upward and downward. The angular travel of the arm 5 is, for example, 180°.

FIG. 2 depicts a simplified view of the arrangement shown in FIG. 1. The arm 5 forks out just beyond its point of attachment to the console 3, thereby forming a pair of tines 11 that are configured such that they diverge, but are parallel to one another in the vicinity of the far end 7 of the arm, where a holder 13 that has already been mentioned is provided between the tips 12 of the tines. The holder retains the shower head 8, which is also situated between the tips 12 of the tines.

How the holder looks in detail may be seen from a first sample embodiment, which is shown in FIG. 3. The housing of the shower head 8 is disk-shaped and has a roughly elliptical outer perimeter. A pair of jaws 14 whose inner surfaces are contoured to match the outer surface of the shower head's housing is arranged on the inner faces of the tines 11 of the arm 5, which accommodate the shower head 8 in a sort of form-fit clamp, where the forces exerted by the mating surfaces involved act upward and downward. However, the clamping action along the direction normal to the plane of the paper is due to an interference fit. Either an indirect clamping in each of the clamping jaws 14 or a tensioning of the pair of clamping jaws 14 toward one another, which may be actuated by a knob 6, may be employed for that purpose. That tensioning of the clamping jaws 14 toward one another may be obtained by providing that their separation is slightly less than the corresponding lateral dimension, or diameter, of the housing of the shower head 8, which will provide that they will be tensioned when the shower head's housing is inserted between the pair of clamping jaws 14, normal to the plane of the paper. Their tensioning will thus be caused by a deformation of the pair of tines 11 of the arm. The extensions of the clamping jaws 14 normal to the plane of the paper in FIG. 3 are rather short in order that they will grip the shower head's housing at two diametrically opposed locations thereon only, and only over very short portions of its perimeter, as is shown in simplified form in FIG. 4.

FIG. 5 shows how the pair of jaws 14 on the holder might be bound together by a bail 15 that is either adapted to suit the shape of the housing of the shower head 8 or is configured such that it will flex in a manner that will allow it to conform to the latter's shape. Employing the bail 15, which is essentially stressed in tension, will allow attaining a heightening of the clamping action.

One of the clamping jaws 14 is mounted on the tip 12 of each of the pair of tines 11 of the arm such that both are free to rotate in order that the holder, together with the shower head 8, may be pivoted about a horizontal axis. An arresting component, similar to the knob 6 shown in FIG. 1, may be provided for the purpose of providing a facility for locking the shower head at a particular position.

The shower head may be grasped by its grip 9 and withdrawn from the holder normal to the plane of the paper in FIG. 5 or FIG. 2, preferably toward the wall, which is a direction of withdrawal (or introduction) along the direction of the grip, as shown by FIGS. 1 and 2. If the jaws 14 (cf, also FIG. 4) have arched inner faces 16 at the central plane of the housing of the shower head 8, a certain latching of the shower head's housing in the holder will occur, without need for the shower head's housing having a shape that will allow recognizing that it is to be held in the holder at that location. When the shower head is withdrawn from the holder, there are no visible indications that it is intended for mounting on a shower-head holder.

FIG. 2 depicts an embodiment where the shower head, together with its holder, is mounted between the tips of a fork. Of course, it will also be feasible to provide that such a holder may be mounted on an arm that does not constitute a fork, and that option is also covered by the invention. That option may be implemented by, for example, providing that the holder, as shown, is mounted on the side of the far end of an arm. For example, in FIG. 2, one might imagine that one of the pair of tines 11 is absent, in which case, one would obtain an embodiment in which the holder would be arranged on one side of the remaining arm, or be asymmetrically arranged thereon.

Of course, it will also be feasible to, for example, mount the center of the tensioning component 15 on the far end of an arm, in which case, of course, facilities for incorporating a rotation axis might also be provided.

What is claimed is:

1. A wall mounting for detachably mounting a shower head, comprising:

a holder for the shower head wherein the holder is attachable to a wall and configured for engaging a location on a housing of the shower head provided for mounting the shower head, wherein the housing of the shower head is disk-shaped and the shower head is configured in a form of a hand-held shower head with a grip extending from the housing;

wherein the holder engages on the housing of the shower head by a pair of jaws gripping an outer perimeter of the housing of the shower head between two diametrically opposed locations at a widest part of the housing of the shower head, the holder acting by means of an interference fit with the housing and permitting withdrawal and introduction of the shower head between the jaws, along a direction of the grip; and, wherein the shower head is operational in the holder and remains operational when withdrawn from the mounting.

2. A wall mounting according to claim 1, wherein the jaws are drawn toward one another when the shower head is in place therein.

3. A wall mounting according to claim 1, wherein the pair of jaws are joined to the holder for the shower head by a component that is under tension.

4. A wall mounting according to claim 3, wherein the tensioning component is configured such that it contacts the housing of the shower head over an extended area.

5. A wall mounting according to claim 1, wherein the holder for the shower head is arranged between tines of a fork.

6. A wall mounting for detachably mounting a shower head, comprising:

a holder for the shower head wherein the holder is attachable to a wall and configured for engaging a location on a housing of the shower head provided for mounting the shower head, wherein the housing of the shower head is disk-shaped and the holder acts by means of an interference fit along withdrawal and introduction directions of the shower head;

wherein the holder engages on the housing of the shower head by a pair of jaws gripping an outer perimeter of the housing of the shower head between two diametrically opposed locations on the housing of the shower head; and, wherein the shower head is operational in the holder and remains operational when withdrawn from the mounting.

7. A wall mounting according to claim 6, wherein the shower head is configured in a form of a hand-held shower head having a grip attached to its housing.

* * * * *